US006298793B1

(12) United States Patent
Turner et al.

(10) Patent No.: US 6,298,793 B1
(45) Date of Patent: Oct. 9, 2001

(54) ACCESSORY TRAY

(75) Inventors: Dennis M. Turner, Mooresville; Nancy Rasche, Lebanon; Andrew Mendenhall, Indianapolis, all of IN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/549,759

(22) Filed: Apr. 14, 2000

(51) Int. Cl.[7] ..... A47B 85/00
(52) U.S. Cl. ..... 108/26; 108/47
(58) Field of Search ..... 108/26, 152, 25, 108/42, 46, 49

(56) References Cited

U.S. PATENT DOCUMENTS

| | | | | |
|---|---|---|---|---|
| 4,165,123 | * | 8/1979 | Hutson | 108/26 X |
| 4,765,575 | * | 8/1988 | Bergl et al. | 108/152 X |
| 5,586,800 | * | 12/1996 | Triplett | 108/26 X |
| 5,799,803 | * | 9/1998 | Muller | 108/152 X |
| 5,810,432 | | 9/1998 | Haut et al. . | |
| 5,964,501 | | 10/1999 | Magnani . | |
| 6,082,537 | * | 7/2000 | Quinn | 108/152 X |
| 6,142,140 | * | 11/2000 | Shumaker | 108/152 X |

* cited by examiner

*Primary Examiner*—Jose V. Chen
(74) *Attorney, Agent, or Firm*—Barnes & Thornburg

(57) ABSTRACT

An accessory tray, and particularly to an accessory tray configured to hold items associated with feeding young children is provided. More particularly, an accessory tray for use with a juvenile high chair is provided.

28 Claims, 5 Drawing Sheets

ACCESSORY TRAY

BACKGROUND AND SUMMARY OF THE INVENTION

This invention relates to an accessory tray, and particularly to an accessory tray configured to hold items associated with feeding young children. More particularly, the present invention relates to an accessory tray for use with a juvenile high chair.

Caregivers often lack a handy place to store bottles, juice boxes, cups, spoons, towels, food items, and other items associated with feeding young children seated in high chairs while the caregivers sit or stand alongside a high chair during mealtime. In some environments, a table or kitchen counter may not be near to the caregiver as the caregiver helps to feed a young child seated in a high chair. As a result, no convenient place exists for the caregiver to use to hold those items to be used by the caregiver during feeding of a young child seated in a high chair or other juvenile seat.

According to the present invention, an accessory tray is adapted to be coupled to and uncoupled from an edge of a juvenile high chair tray. The accessory tray includes an item-storage platform having a top surface adapted to receive items used by a caregiver during the feeding of a young child and a rear edge adapted to mate with an edge of a juvenile high chair tray.

The accessory tray further includes a first connector arranged to extend from the rear edge of the item-storage platform to engage a topside portion for a perimeter rim along the edge of the juvenile high chair tray. The accessory tray also includes a second connector arranged to extend from the rear edge of the item-storage platform to engage an underside portion of the perimeter rim to steady the accessory tray in its mounted position on the juvenile high chair tray.

In preferred embodiments, the first connector includes two elongated, vertical, U-shaped hooks positioned to lie in spaced-apart relation to one another and to extend upwardly above the top surface of the item-storage platform and the second connector includes two elongated, horizontal, flattened side flanges positioned to lie in spaced-apart relation to one another and to extend rearwardly from a point below the top surface of the item-storage platform. The second connector also includes a ramped central flange positioned to lie between and in spaced-apart relation to each of the elongated, horizontal, flattened side flanges.

Additional features of the present invention will become apparent to those skilled in the art upon consideration of the following detailed description of preferred embodiments exemplifying the best mode of carrying out the invention as presently perceived.

DETAILED DESCRIPTION OF THE DRAWINGS

Figure 2:
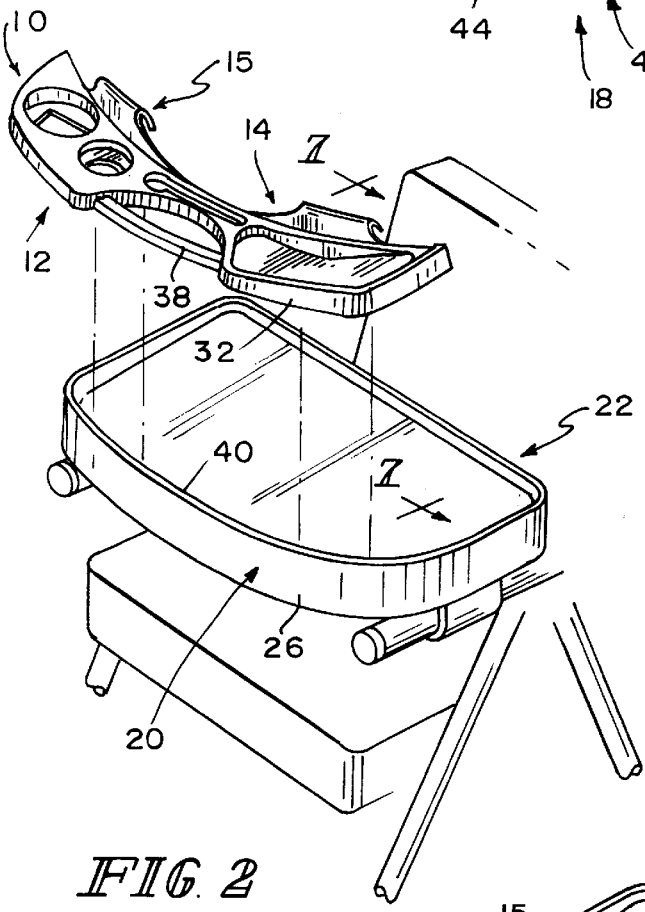
FIG. 2 is a front perspective view of an accessory tray in accordance with the present invention prior to installation of the accessory tray onto a perimeter rim of a juvenile high chair tray.
Figure 3:
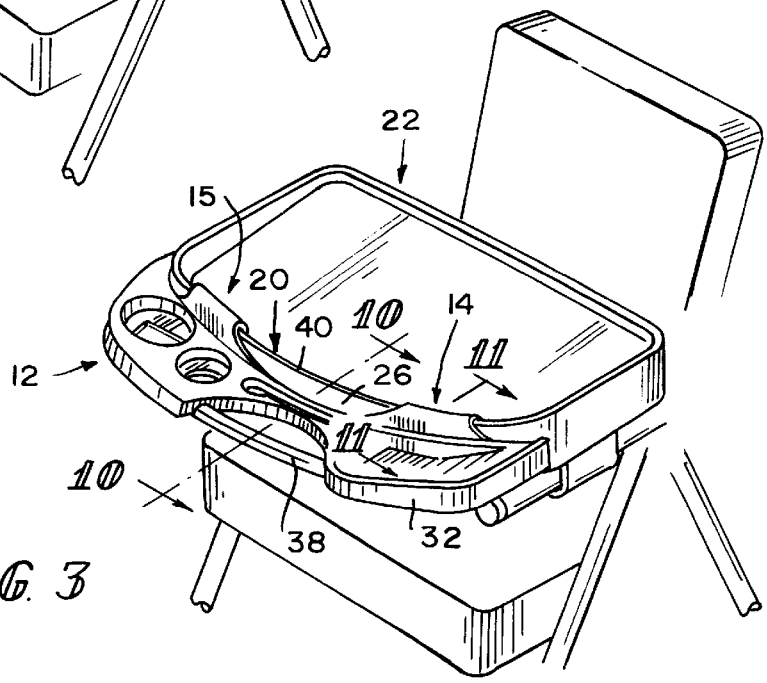
FIG. 3 is a view similar to FIG. 2 showing the accessory tray of FIGS. 1 and 2 in a mounted position on the juvenile high chair tray.
Figure 4:
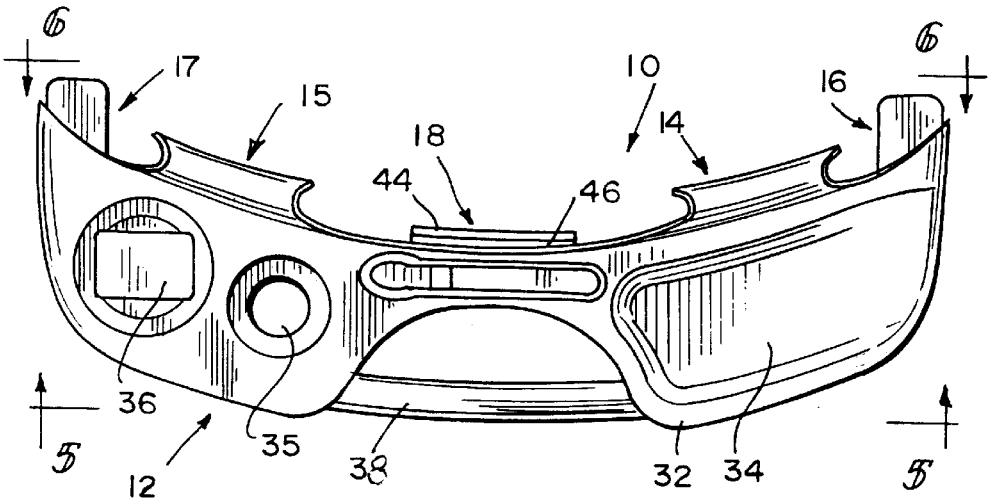
FIG. 4 is a top plan view of the accessory tray of FIG. 1.
Figure 5:
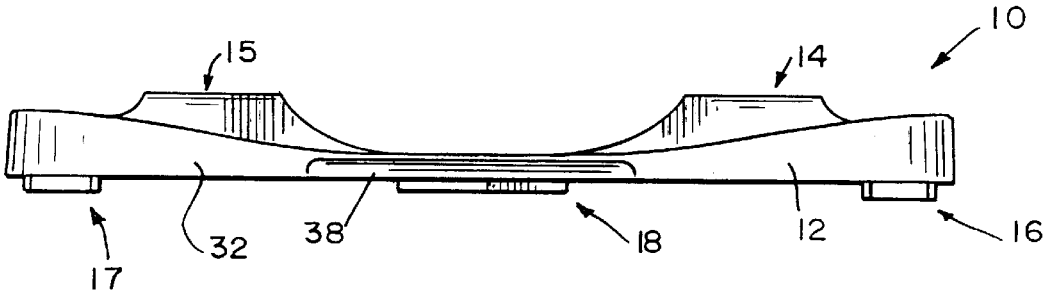
FIG. 5 is a front elevation view of the accessory tray shown in FIG. 4.
Figure 7:
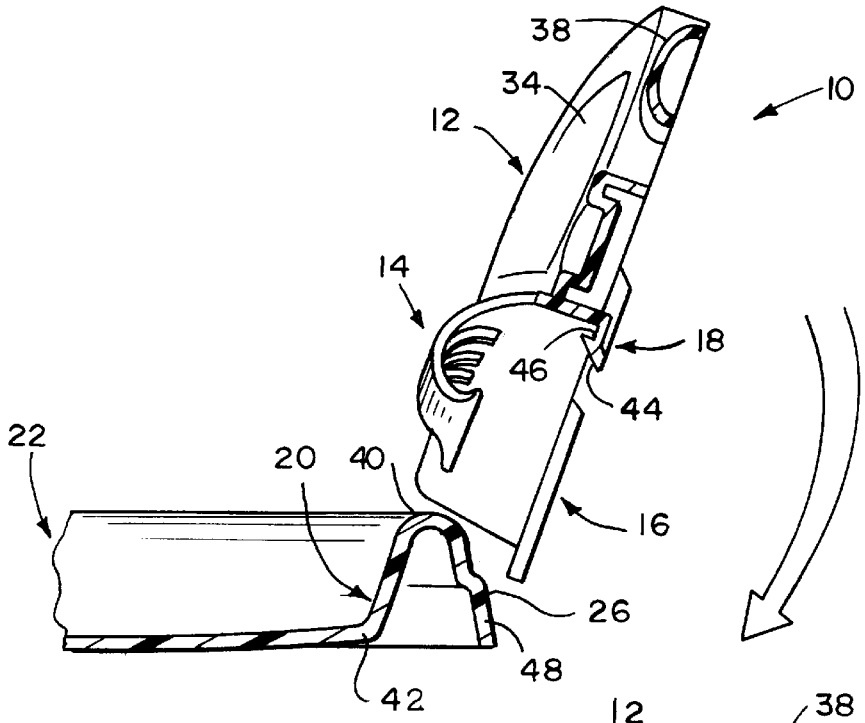
FIG. 7 is a sectional view taken along lines 7—7 of FIG. 2 showing the position of one of the U-shaped hooks that extends from the rear edge of the item-storage platform as it is about to engage a topside portion of the perimeter rim of a high chair tray as the accessory tray is being mounted on the high chair tray.
Figure 8:
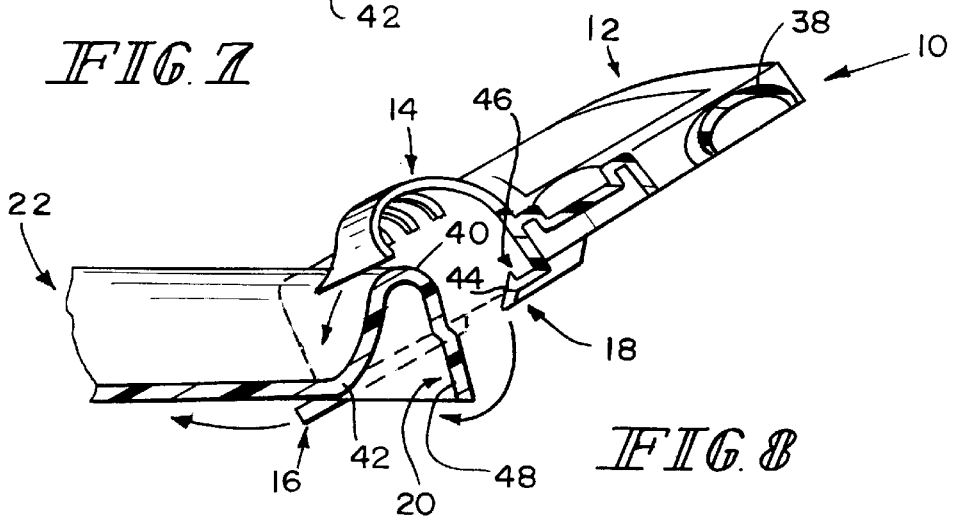
FIG. 8 is a sectional view similar to FIG. 7 showing sliding movement of one of the horizontal, flattened side flanges that extends from the rear edge of the item-storage platform as it engages an underside portion of the perimeter rim of the high chair tray as the accessory tray is being mounted on the high chair tray.
Figure 9:
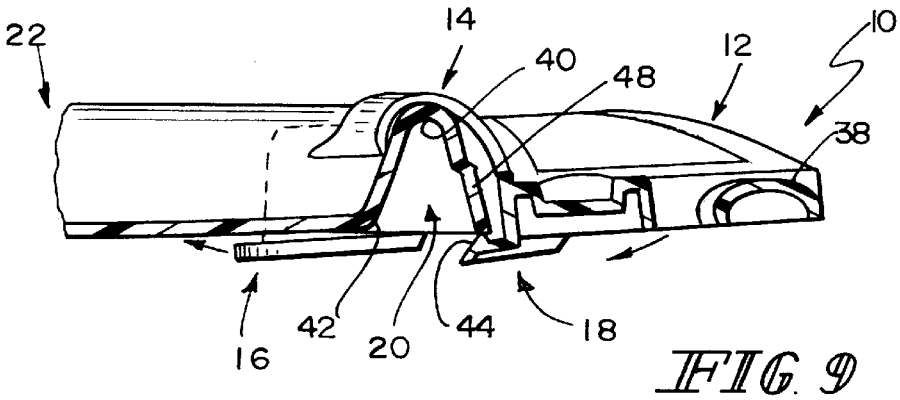
FIG. 9 is a sectional view similar to FIGS. 7 and 8 showing a further stage of tray attachment wherein a ramped central flange that also extends from the rear edge of the item-storage portion has been "ramped" under the underside portion of the perimeter rim of the high chair tray but before a lower portion of that perimeter rim "snaps" into a channel provided in the accessory tray between the ramped central flange and the item-storage platform.

An accessory tray 10 includes an item-storage platform 12, a pair of hooks 14, 15, a pair of side flanges 16, 17, and a central flange 18. Hooks 14, 15 and flanges 16, 17, 18 cooperate to engage a perimeter rim 20 of a high chair tray 22 in the manner shown in FIGS. 7–10 to enable a child caregiver to mount accessory tray 10 onto high chair tray 22 as shown in FIGS. 2 and 3. Hooks 14, 15 and flanges 16, 17, 18 are configured to enable the caregiver to disconnect accessory tray 10 from a mounted position of high chair tray 22 easily by "reversing" the installation process shown in FIGS. 7–9.

Item-storage platform 12 is adapted to mate with perimeter rim 20 of high chair tray 22 when accessory tray 10 is mounted on high chair tray 22 as shown, for example, in FIG. 3. Item-storage platform 12 includes a rear edge or wall 24 (shown best in FIG. 1) which is configured to match a front edge or wall 26 (shown best in FIG. 2) of perimeter rim 20 to facilitate mounting of accessory tray 10 onto high chair tray 12. Rear edge 24 includes an upper end 28 and a lower end 30 as shown best in FIG. 1. Item-storage platform 12 further includes a tray portion 32 formed to include receptacles 34, 35, 36, 37 and a carrying handle 38 that also serves as a towel bar when accessory tray 10 is mounted onto high chair tray 12.

Figure 1:
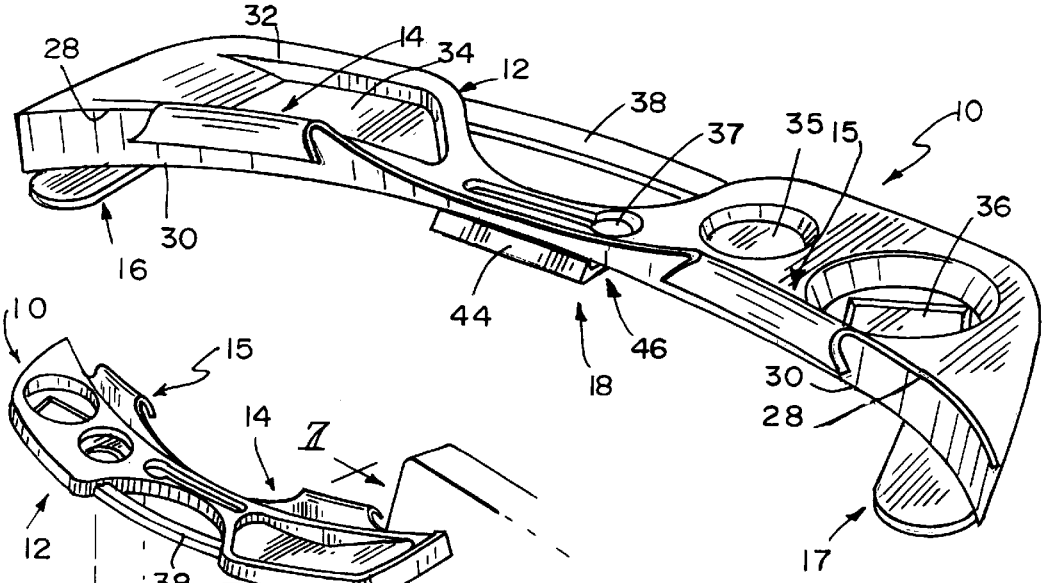
FIG. 1 is a rear perspective view of an accessory tray in accordance with the present invention showing an item-storage platform, two upper spaced-apart hooks appended to a rear edge of the platform, two lower spaced-apart flanges also appended to a rear edge of the platform, and a lower central flange appended to a rear edge of the platform and positioned to lie between and below the two upper hooks.
Figure 6:
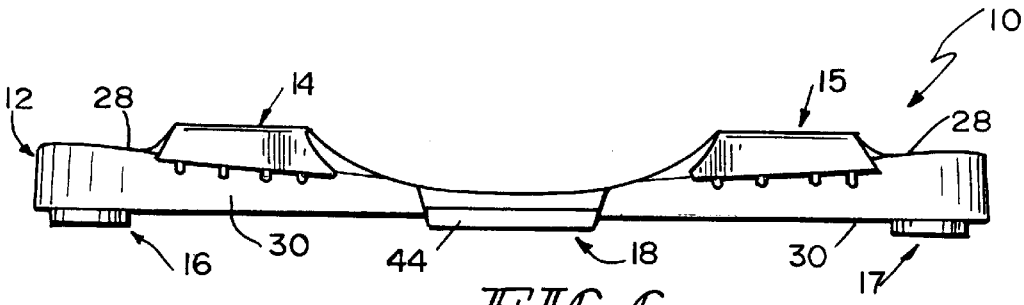
FIG. 6 is a rear elevation of the accessory tray shown in FIG. 4.

Each of hooks 14, 15 is elongated and U-shaped and coupled to upper end 28 of rear edge 24 as shown, for example, in FIGS. 1 and 6. U-shaped hooks 14, 15 are positioned to lie in spaced-apart relation to one another along upper end 28. Hooks 14, 15 cooperate to establish a cantilevered first connector that is arranged to extend from rear edge 24 of item-storage platform 12 to engage a topside portion 40 of perimeter rim 20 of high chair tray 22 to facilitate mounting of accessory tray 10 onto high chair tray 22.

Each of side flanges 16, 17 is elongated and coupled to lower end 30 of rear edge 24 as shown, for example, in FIGS. 1 and 6. Flattened side flanges 16, 17 are positioned to lie in spaced-apart relation to one another along lower end 30 to position the two U-shaped hooks 14, 15 therebetween. Central flange 18 is elongated and coupled to lower end 30 of rear edge 24 as shown, for example, in FIGS. 1 and 6. Central flange 18 is positioned to lie between side flanges 16, 17 and below and between U-shaped hooks 14, 15. Side flanges 16, 17 and central flange 18 cooperate to establish a cantilevered second connector that is arranged to extend from rear edge 24 of item-storage platform 12 to engage an underside portion 42 of perimeter rim 20 of high chair tray 22 to facilitate mounting of accessory tray 10 onto high chair tray 22.

Figure 10:
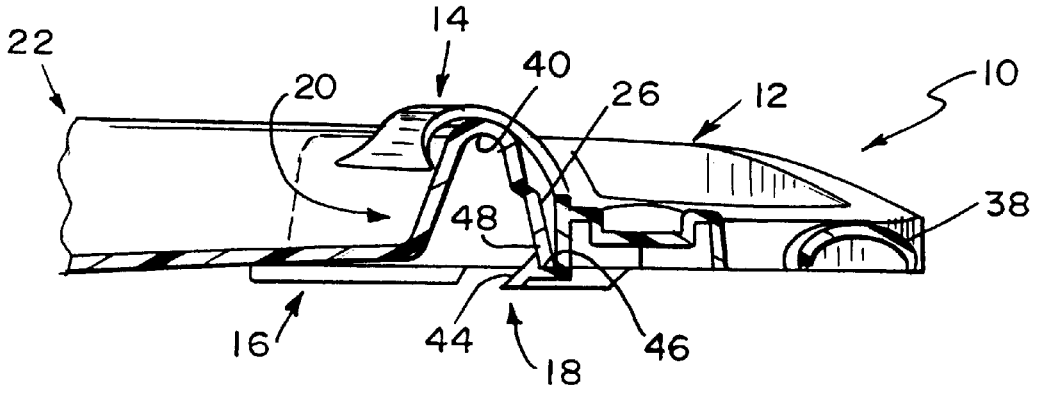
FIG. 10 is a sectional view taken along line 10—10 of FIG. 3 showing coupling of one of the hooks to a topside portion of a perimeter rim of the juvenile high chair tray and coupling of the central flange and one of the side flanges to an underside portion of the perimeter rim of the juvenile high chair tray.
Figure 11:
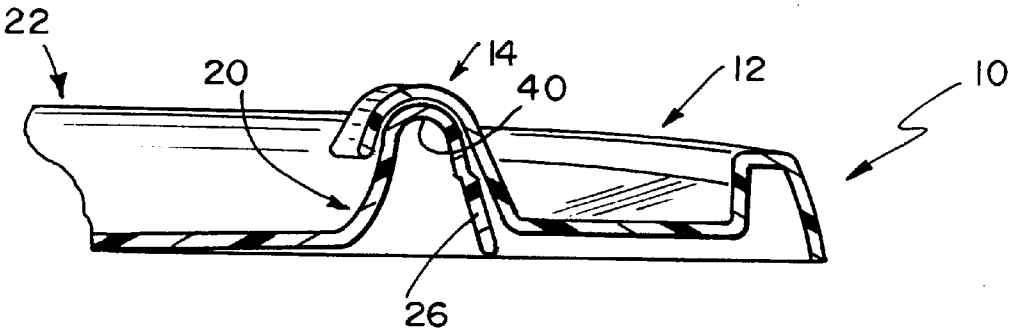
FIG. 11 is a sectional view taken along line 11—11 of FIG. 3.
Figure 12:
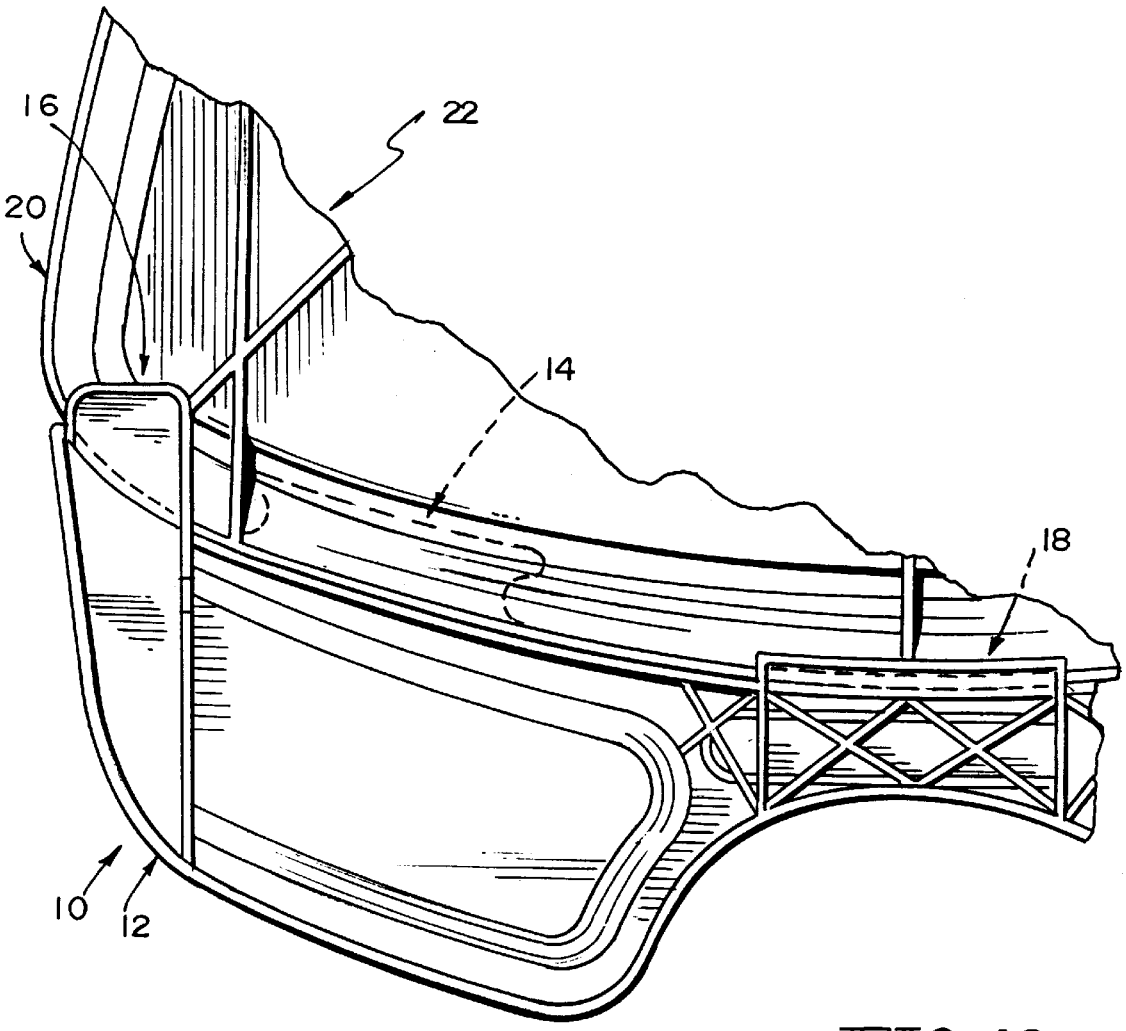
FIG. 12 is a bottom view of a portion of the accessory tray coupled to the high chair tray as shown in FIG. 3.
Figure 13:
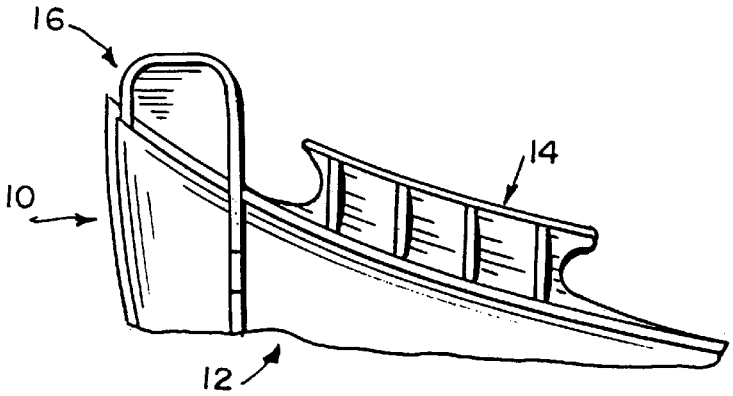
FIG. 13 is a bottom view of a portion of the accessory tray showing the hook and flange illustrated in FIGS. 10 and 11.

Central flange 18 is formed to include a sloped ramp 44 arranged to face away from rear edge 24 of item-storage platform and a curved channel 46 formed to lie in a position between rear edge 24 and sloped ramp 44. Curved channel 46 is configured to receive a portion 48 of perimeter rim 20 therein as shown in FIG. 10 upon engagement of hooks 14, 15 and flanges 16, 17, 18 to perimeter rim 20 of high chair tray 22.

Accessory tray 10 is mounted onto perimeter rim 20 of high chair tray 22 in the manner shown in FIGS. 7–10. Flattened side flanges 16, 17 slide under underside portion 42 of perimeter rim 20. Portion 48 of perimeter rim 20 is cammed on sloped ramp 44 of central flange 18 until it fits into curved channel 46 formed in central flange 18. Accessory tray 10 is disconnected from high chair tray 22 by reversing the installation process just described.

Although the invention has been described in detail with reference to certain preferred embodiments, variations, and modifications exist within the scope and spirit of the invention as described and defined in the following claims.

What is claimed is:

1. An accessory tray to mount on a juvenile high chair tray, the accessory tray comprising an item-storage platform including a rear edge adapted to mate with a perimeter rim of a high chair tray, a first connector arranged to extend a first distance from the rear edge of the item-storage platform and adapted to engage a top side portion of the perimeter rim of the high chair tray, and a second connector, a portion of the second connector being arranged to extend a second distance from the rear edge of the item-storage platform and adapted to engage an underside portion of the perimeter rim, the second distance being greater than the first distance.

2. The accessory tray of claim 1, wherein the rear edge includes upper and lower ends, the first connector is coupled to the upper end, and the second connector is coupled to the lower end to lie below the first connector.

3. The accessory tray of claim 2, wherein the first connector includes two U-shaped hooks positioned to lie in spaced-apart relation to one another along the upper end of the rear edge.

4. The accessory tray of claim 3, wherein the second connector includes two side flanges positioned to lie in spaced-apart relation to one another along the lower end of the rear edge to position the two U-shaped hooks therebetween.

5. The accessory tray of claim 3, wherein the second connector includes a central flange positioned to lie along the lower end of the rear edge between the two U-shaped hooks.

6. The accessory tray of claim 3, wherein the second connector includes two side flanges positioned to lie in spaced-apart relation to one another along a lower end of the rear edge to position the two U-shaped hooks therebetween and a central flange positioned to lie along the lower end of the rear edge between the two side flanges and between the two U-shaped hooks.

7. The accessory tray of claim 1, wherein the rear edge includes a left end, a right end, and a middle section positioned to lie between the left and right ends and the second connector includes a left side flange coupled to the left end and a right side flange coupled to the right end.

8. The accessory tray of claim 7, wherein the first connector is coupled to the middle section.

9. The accessory tray of claim 8, wherein the first connector includes two U-shaped hooks positioned to lie in spaced-apart relation to one another.

10. An accessory tray to mount on a juvenile high chair tray, the accessory tray comprising an item-storage platform including a rear edge adapted to mate with a perimeter rim of a high chair tray, a first connector arranged to extend from the rear edge of the item-storage platform and adapted to engage a top side portion of the perimeter rim of the high chair tray, and a second connector arranged to extend from the rear edge of the item-storage platform and adapted to engage an underside portion of the perimeter rim, the rear edge including a left end, a right end, and a middle section positioned to lie between the left and right ends and the second connector including a left side flange coupled to the left end and a right side flange coupled to the right end, and wherein the second connector further includes a central flange coupled to the middle section.

11. The accessory tray of claim 10, wherein the central flange is formed to include a sloped ramp arranged to face away from the rear edge of the item-storage platform and a channel formed to lie in a position between the rear edge and the sloped ramp and adapted to receive the perimeter rim of the high chair tray therein upon engagement of the first and second connectors to the perimeter rim of the high chair tray.

12. The accessory tray of claim 10, wherein the first connector includes a first U-shaped hook coupled to the middle section and positioned to lie between the left and central flanges and a second U-shaped hook coupled to the middle section and positioned to lie between the central and right flanges.

13. The accessory tray of claim 10, wherein the central flange extends a first distance from the rear edge and each of the left and right side flanges extend a second distance from the rear edge and the second distance is greater than the first distance.

14. The accessory tray of claim 13, wherein the central flange is adapted to engage a lower edge of the perimeter rim of the juvenile chair tray and each of the left and right side flanges include a tip portion adapted to engage a downwardly facing bottom wall of the juvenile chair tray and an inner portion positioned to lie between the tip portion and the rear edge and adapted to engage the lower edge of the perimeter rim of the juvenile chair tray.

15. The accessory tray of claim 10, wherein the rear edge is a vertical wall having an upper end coupled to the first connector and a lower end coupled to the second connector.

16. The accessory tray of claim 15, wherein the vertical wall is a curved wall and each of the left and right side flanges has a first side edge having a first length and a second side edge having a second length shorter than the first length.

17. A tray system comprising a chair tray, an item-storage platform arranged to mate with a perimeter rim of the chair tray, a pair of hooks coupled to the item-storage platform to lie in spaced-apart relation to one another and arranged to engage a top side portion of the perimeter rim of the chair tray, and a pair of side flanges coupled to the item-storage platform to lie in spaced-apart relation to one another and below the pair of hooks to engage a downwardly facing bottom wall of the chair tray.

18. The tray system of claim 17, further comprising a central flange positioned to lie between the side flanges and below the pair of hooks and arranged to engage an underside portion of the perimeter rim.

19. The tray system of claim 18, wherein the central flange is positioned to lie between the pair of hooks.

20. The tray system of claim 18, wherein the item-storage platform includes a rear edge coupled to the central flange and the central flange is formed to include a sloped ramp arranged to face away from the rear edge of the item-storage platform and a channel formed to lie in a position between the rear edge and the sloped ramp and to receive the perimeter rim of the chair tray therein upon engagement of the hooks and flanges to the perimeter rim of the chair tray.

21. The tray system of claim 17, wherein the hooks are positioned to lie between the side flanges.

22. The tray system of claim 17, wherein each hook is U-shaped and each side flange is flat.

23. The tray system of claim 17, wherein the tray is formed to include a channel lying between the perimeter rim and the downwardly facing bottom wall and each side flange includes a distal top engaging the downwardly facing bottom wall, a root portion coupled to the item-storage platform, and a bridge portion interconnecting the root portion and the distal tip and extending across the channel.

24. The tray system of claim 17, wherein each side flange engages a lower edge of the perimeter rim.

25. A tray system comprising a juvenile chair tray including a table surface and a perimeter rim coupled to the table surface and an accessory tray including an item-storage platform and a disconnectable mount coupled to the item-storage platform and coupled to the perimeter rim to support and cantilever the item-storage platform in a fixed position alongside the table surface of the juvenile chair tray, the disconnectable mount including a first connector configured to engage a top side portion of the perimeter rim and a portion of the second connector arranged to engage a lower edge of the perimeter rim.

26. The tray system of claim 25, wherein the first connector includes two U-shaped hooks and the second connector includes a central flange positioned to lie between the U-shaped hooks and two side flanges arranged to lie in spaced-apart relation to one another to position the two U-shaped hooks and the central flange therebetween.

27. The tray system of claim 26, wherein the table surface is oriented to face upwardly in a first direction, the juvenile chair tray further includes a bottom surface arranged to lie below the table surface in spaced-apart relation to the lower edge of the perimeter rim and oriented to face downwardly in a second direction, the central flange engages the lower edge of the perimeter rim, and the two side flanges engage the bottom surface of the juvenile chair tray.

28. The tray system of claim 25, wherein the second connector includes a central flange formed to include a sloped ramp and a channel formed to lie in a position between the sloped ramp and the item-storage platform and the lower edge of the perimeter rim is received in the channel upon engagement of the first and second connectors to the perimeter rim of the juvenile chair tray.

* * * * *